United States Patent [19]

Fisher et al.

[11] 3,944,083

[45] Mar. 16, 1976

[54] BOTTOM HANDLING APPARATUS FOR STEEL CONVERTER VESSELS

[75] Inventors: Howard M. Fisher; Bernd G. Albers; John W. Mrozek, all of New Castle, Pa.

[73] Assignee: Pennsylvania Engineering Corporation, Pittsburgh, Pa.

[22] Filed: Mar. 21, 1974

[21] Appl. No.: 453,188

[52] U.S. Cl. ..... 214/1 D; 266/36 P

[51] Int. Cl.[2] ..... C21C 5/50

[58] Field of Search ..... 214/1 D, 1 R, 1 H; 266/35, 266/36 P, 13; 105/177; 29/200 D, 244, 252

[56] References Cited

UNITED STATES PATENTS

| | | | |
|---|---|---|---|
| 2,224,901 | 12/1940 | Cunningham | 214/1 D X |
| 2,523,734 | 9/1950 | Stephenson et al. | 214/1 D |
| 3,312,544 | 4/1967 | McCready et al. | 266/13 X |
| 3,524,556 | 8/1970 | Miller | 214/1 D |
| 3,715,101 | 2/1973 | Puhringer | 214/1 D X |
| 3,718,265 | 2/1973 | Trost | 214/1 D |
| 3,820,665 | 6/1974 | Fisher | 214/1 D |

FOREIGN PATENTS OR APPLICATIONS

| | | | |
|---|---|---|---|
| 1,500,012 | 9/1967 | France | 214/1 D |
| 750,905 | 1/1945 | Germany | 266/3 S |

*Primary Examiner*—Frank E. Werner

[57] ABSTRACT

A converter vessel bottom handling device having a frame adapted to be supported on a car and which in turn supports a bilaterally movable support table. Four double acting hydraulic lift cylinders are mounted on the support table for vertically moving a lift table upon which is mounted a tilt table adapted to engage and support a converter vessel bottom. A first and second plurality of hydraulic cylinders are coupled to the tilt table for tilting the same relative to the horizontal plane and for rotating said table about a central vertical axis. A set of lugs affixed to the tilt table are provided to be keyed to mating lugs on the vessel bottom for exerting a downward breakaway force on the vessel bottom through the use of the lift cylinders when removal of the bottom becomes necessary.

In an alternate embodiment, a plurality of jacks are provided on the vessel bottom for exerting a breakaway force between the vessel and vessel bottom assembly.

23 Claims, 12 Drawing Figures

BOTTOM HANDLING APPARATUS FOR STEEL CONVERTER VESSELS

BACKGROUND OF THE INVENTION

This invention relates to apparatus for handling the bottom assembly of a metallurgical vessel such as a bottom blown steel converter vessel. As is known, it is necessary periodically to remove the bottom assembly of bottom blown steel converter vessels for the purpose of rebuilding the refractory bottom and for replacing its tuyeres. It is desirable that bottom removal and replacement be done in a minimum amount of time in order to minimize disruption of production. Hand methods of vessel bottom installation and removal are very time consuming and requires a considerable number of workmen.

SUMMARY OF THE INVENTION

An object of the present invention is to provide apparatus for the rapid and safe removal and replacement of bottom assemblies for metallurgical vessels, particularly those of the bottom blown type.

Another object of this invention is to provide a vessel bottom handling apparatus which may be mounted quickly on an available transport device and positioned beneath the vessel on tracks.

A more specific object of the invention is to provide a metallurgical vessel bottom handling apparatus that is adapted for supporting the vessel bottom assembly while it is being uncoupled from the metallurgical vessel and that is capable of exerting a downward removal force to separate the vessel bottom from the vessel.

Still another object of the invention is to provide a metallurgical vessel bottom handling apparatus which is selectively movable in several directions to facilitate alignment of the bottom assembly when it is being removed or replaced in the vessel.

Another object of the invention is to provide a metallurgical vessel bottom handling device which permits vertical, horizontal, rotational and tilting movements.

How the foregoing and other more specific objects are achieved will appear throughout the course of a more detailed description of a preferred embodiment of the invention which will be set forth shortly hereinafter.

In general terms, the new bottom assembly handling apparatus comprises a horizontally movable first support elevating means mounted on the first support for vertically moving a second support, a vessel engaging support is mounted on the second support and motive means are provided to selectively rotating and tilting the vessel engaging support relative to the second support. The vessel support is selectively engageable with a removable metallurgical vessel bottom to support the vessel bottom for replacement or removal and may further be adapted to exert a downward force through the lifting devices to facilitate removal of the vessel bottom from the vessel.

DESCRIPTION OF A PREFERRED EMBODIMENT

Figure 1:
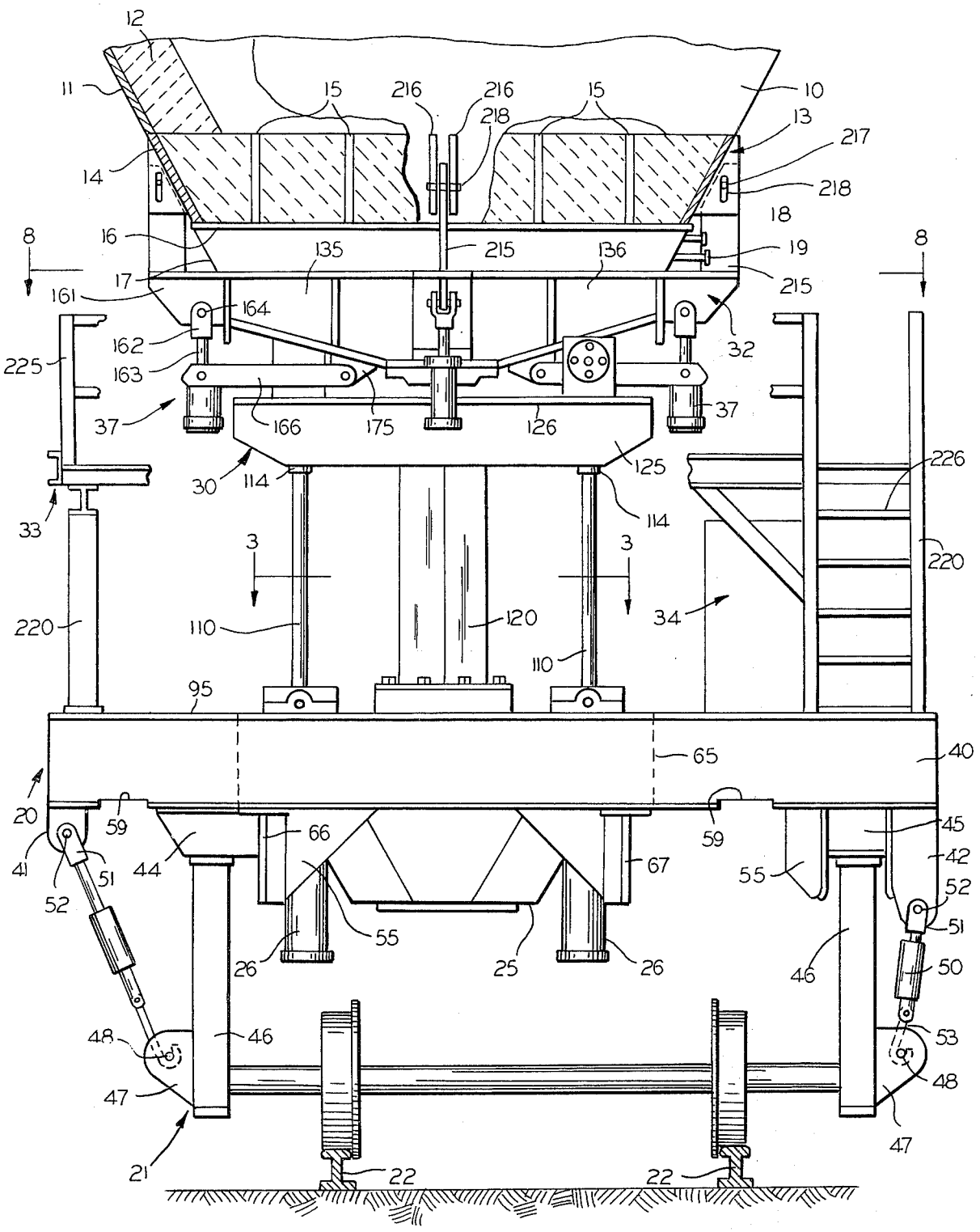
FIG. 1 is a side elevational view with parts broken away, of the metallurgical vessel bottom handling apparatus according to a preferred embodiment of the invention.

Referring to FIG. 1, the lower portion of a converter vessel 10 is illustrated to include an outer steel shell 11 and a refractory lining 12. The means for mounting the vessel for tilting on a horizontal axis are not shown since they may be conventional. A removable bottom assembly is generally designated by the reference numeral 13. Those skilled in the art will appreciate that the bottom 13 may be secured to the converter vessel 10 in any conventional manner (not shown).

The bottom assembly 13 may include a refractory body 14 having one or more openings therethrough for receiving tuyeres 15 to permit the delivery of gases to the interior of vessel 10 and beneath the level of metal therein. The tuyeres 15 may include concentric pipes to permit the delivery of a hydrocarbon shielding fluid in surrounding relation to oxygen delivered through the central pipe. In addition, lime and other agents may be entrained in the gas stream for purposes known in the art and for this purpose, a metallic plate 16 supports the refractory body 14 and gas distributors and manifolds (not shown) are coupled to the outer ends of the tuyeres 15 and which are covered by a metallic housing 17. Flanged pipes 18 and 19 communicating with the housing 17 symbolizes fine particles and a hydrocarbon shielding fluid and oxygen gas may be communicated to the separate passageways of the tuyeres and injected into the molten metal within the vessel. Bottom assemblies of the type described for 200 ton capacity vessels may be in the order of 10 feet in diameter and weigh several tons.

Figure 2:
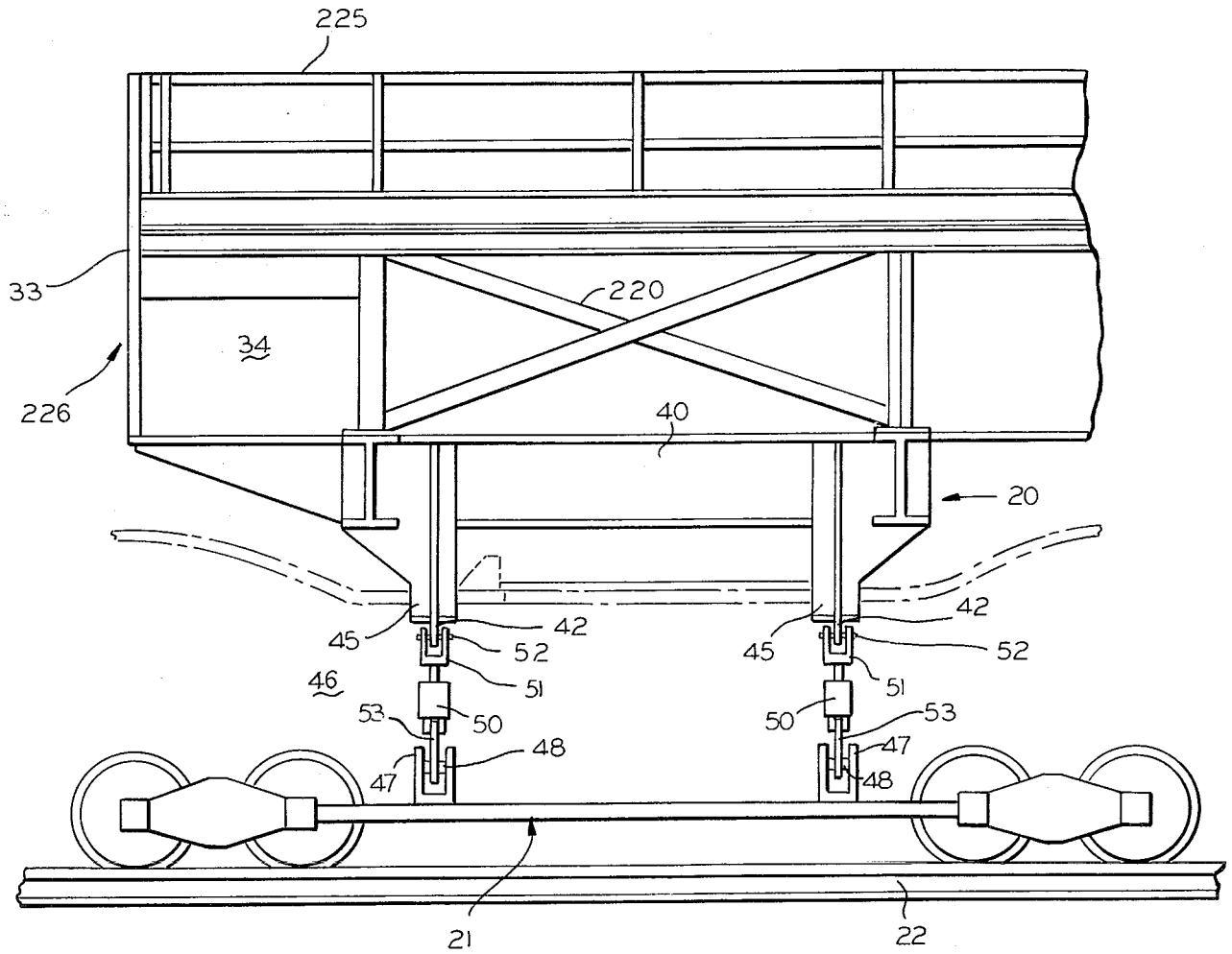
FIG. 2 is a view taken along lines 2—2 of FIG. 1.

Referring generally to FIGS. 1 and 2, the bottom handling apparatus is seen to include an adapter frame 20 adapted to be mounted on any suitable vehicle, such as a ladle car 21 which in turn may roll upon tracks 22 ordinarily located in a pit beneath the converter vessel 10. The adapter frame 20 supports a cylinder support table 25 upon which a plurality of lift cylinders 26 are mounted and whose shafts support lift table 30 for vertical movement. While four lift cylinders 25 are illustrated, it will be appreciated that any suitable number may be employed. The lift table 30 also supports a tilt table 32 which is adapted to support the vessel bottom assembly 13. Adapter frame 20 also serves as a support for a work platform assembly 33 and a hydraulic power supply 34.

Figure 8:
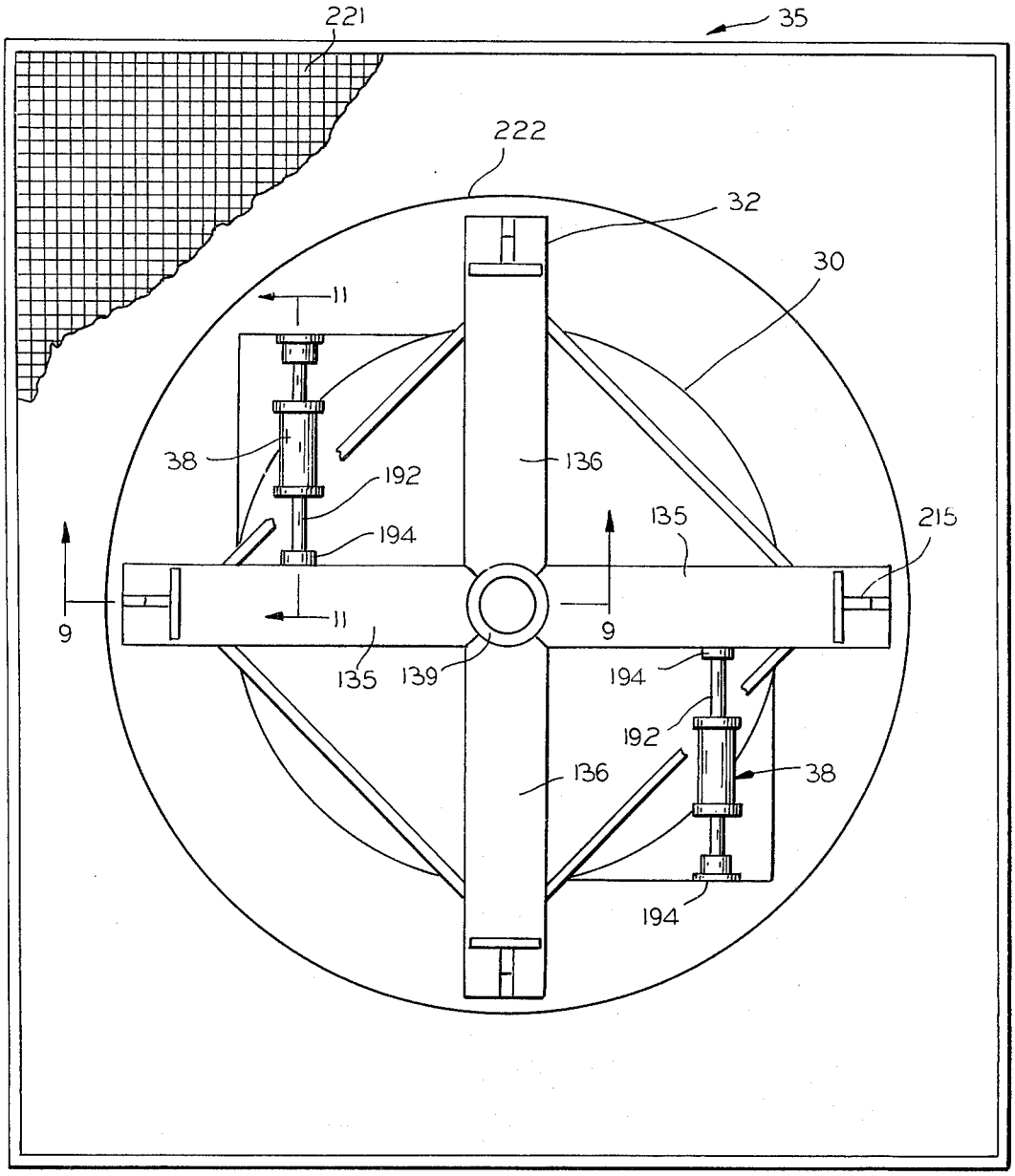
FIG. 8 is a view taken along line 8—8 of FIG. 1.

The cylinder support table 25 serves as a horizontally bilaterally movable base for lift table 30 and tilt table 32. The cylinder support table 25 is slidably supported on adapter frame 20 and is movable in a first direction by a pair of hydraulic cylinders 35 mounted on opposite sides of support table 25. A second pair of cylinders 36 cooperating with the remaining two sides of table 25 provide table motion in a second direction perpendicular to the first direction of motion. Lift cylinders 26 attached to the support table 25 are provided for elevating the lift table 30 upon which the tilt table 32 is mounted. A plurality of hydraulic cylinders 37 are also mounted between the lift table 30 and tilt table 32 for selectively tilting the tilt table 32 relative to a horizontal plane. Further, as seen in FIG. 8, a pair of hydraulic cylinders 38 are also provided for rotating the tilt table 32 about a generally vertical axis. A more detailed description of the relationship and structure of the components just described will be set forth hereinafter. The foregoing general description, however, will make it apparent that the apparatus has the capability of varying the position of tilt table 32 vertically, horizontally, rotationally and tiltably. The tilt table 32 may thus be selectively positioned relative to the vessel 10 to facilitate precise alignment with the vessel bottom 13 either for removal or installation of the vessel bottom 13.

As seen in FIGS. 1 and 2, the adapter frame 20 includes a generally rectangularly shaped framework 40 which is secured to and supported on the ladle car 21 in any suitable manner to form a horizontal platform. For example the frame support assembly may include a first pair of lugs 41 extending vertically downward in spaced relation on the left side as viewed in FIG. 1 and a second pair of lugs 42 extending downwardly on the right side. In addition, first and second pairs of base members 44 and 45 project downwardly along the bottom of the framework 40 and are respectively spaced inwardly from the lugs 41 and 42. The pairs of base members 44 and 45 are located so as to be engageable with vertically extending frame members 46 of the ladle car 21. Each of the frame members 46 of the ladle car 21 has a pair of integral spaced apart vertically extending brackets 47 between which a pin 48 extends. The framework 40 may be secured to the ladle car 21 by any suitable means such as ratchet jack assemblies 50 which extend between each of the lugs 41 and 42 and the pins 48 of brackets 47. Each ratchet jack assembly 50 may include a clevis 51 and pin 52 engaging its respective lug pairs 41 and 42 and a hook 53 which engages the pins 48. The ratchet jacks 50 are well known in the art and need not be described in detail other than to say that they may be tightened to securely hold the framework 40 down against the tops of frame members 46 of the ladle car 21. In order to prevent lateral motion of the framework 40 relative to the ladle car 21, pairs of downwardly extending gusset plates 55 are attached along the bottom of framework 40 and each pair abuts one side 46 of the ladle car 21.

While framework 40 is illustrated as being mounted on a ladle car 21, it will be appreciated that it can also be mounted atop other types of cars as well. Toward this end the framework 40 may also be provided with notches 59 as seen in FIG. 1 for being supported on other types of conventional cars such as a slag pot car, not shown. The framework 40 may be secured to such other cars in a manner similar to that described with respect to the ladle car 21.

Figure 3:
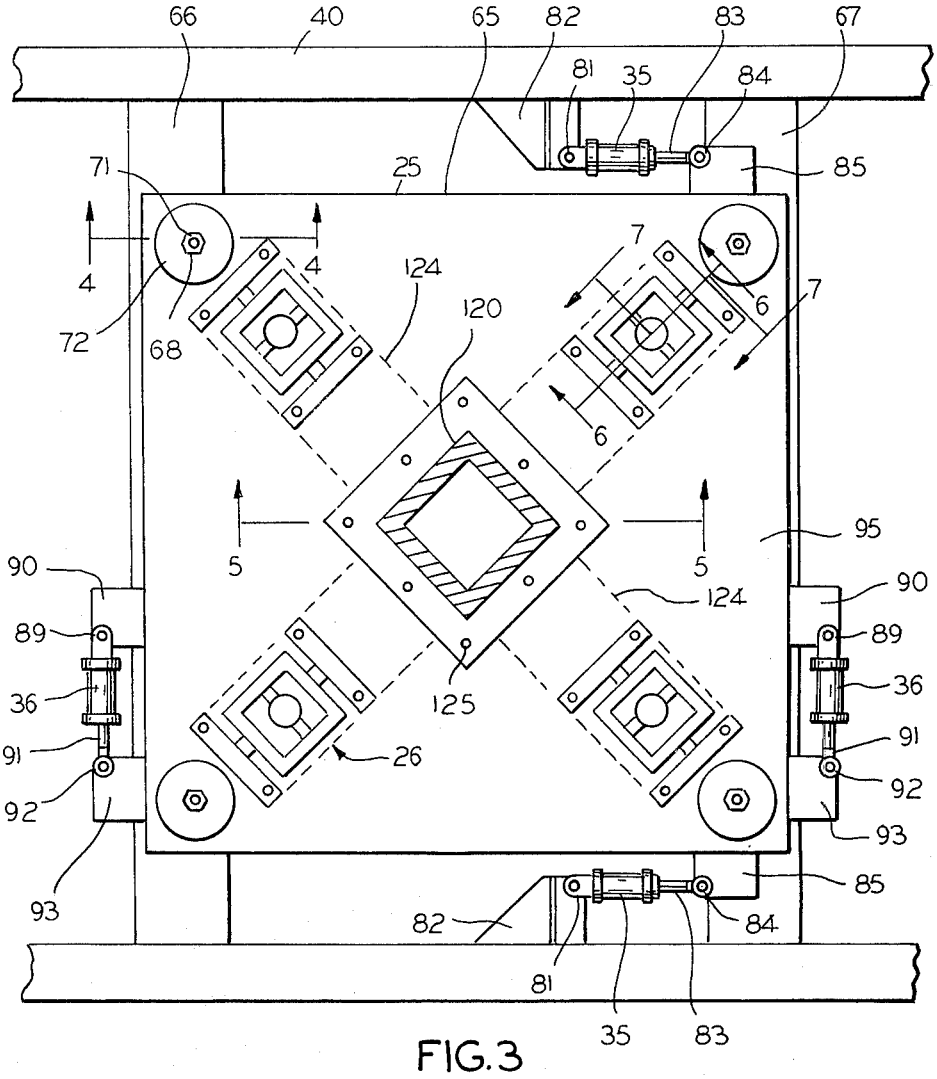
FIG. 3 is a view taken along line 3—3 of FIG. 1.
Figure 4:
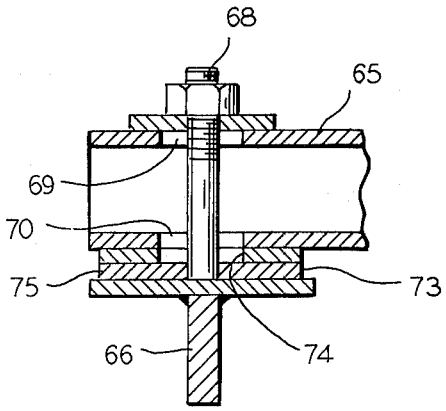
FIG. 4 is a view taken along line 4—4 of FIG. 3.

Referring now to FIGS. 1, 3 and 4, the bidirectionally movable cylinder support table 25 is shown. Table 25 may include a base 65 which is slidably supported on beams 66 and 67 which form a part of the adapter framework 40. Vertical movement of base 65 relative to beam members 66 and 67 is prevented by two studs 68 affixed to each beam 66 and 67 and extending vertically upward through apertures 69 and 70 in the upper and lower portions of frame 65 respectively. Each of the posts 68 threadably receives a nut 71 and a hold-down washer 72 which overlaps the upper apertures 69 and bears against the top surface of the rectangular framework 65. As is shown in FIG. 4, a bearing plate 73 is affixed at each of the four corners of the under surface of base 65. The bearing plates 73 have apertures 74 which substantially match the lower aperture 70 in base 65 through which the studs 68 extend. The bearing plates 73 may be of any suitable bearing material such as bronze and are affixed to base 65 by suitable means such as screws, not shown. Cooperating with the bearing plates 73 are matching bearing plates 74 affixed to beam members 66 and 67 and which are also apertured to permit passage of studs 68. Thus, it may be seen that the base 65 of the cylinder support table 25 is vertically fixed relative to beams 66 and 67 but may be slidably moved in a generally horizontal plane.

The motive force for slidably moving the cylinder support table 25 may be provided by any suitable means such as pairs of double acting cylinders 35 and 36 as best seen in FIG. 3. The cylinders 35 are oriented with their axis generally horizontal and perpendicular to the tracks 22 and have their cylinder bodies pivotally attached by means of a clevis and vertically extending pin assembly 81 to horizontal brackets 82 affixed to the front and back of the adapter framework 40. The shafts 83 of cylinders 35 are also attached by means of clevis and vertical pin assemblies 84 to horizontal brackets 85 affixed to the base 65. Because the cylinders 35 extend generally horizontally and transversally relative to the tracks 22, they are effective for moving the support table 25 laterally within adapter framework 40.

In a similar manner, longitudinal motion of the support table 25 is provided by the acting hydraulic cylinders 36, one of which is located on either side of the base 65 and which extend generally horizontally and paralleling the tracks 22. The bodies of cylinders 36 are similarly attached by means of clevis and vertical pin assemblies 89 to horizontal brackets 90 affixed to beams 66 and 67 of the adapter framework 40. The shafts 91 of cylinders 36 also have clevis and vertically extending pin assemblies 92 which are affixed to horizontal brackets 93 on each side of base 65. Cylinders 35 and 36 may be provided with fluid under pressure from any suitable source, not shown.

Figure 7:
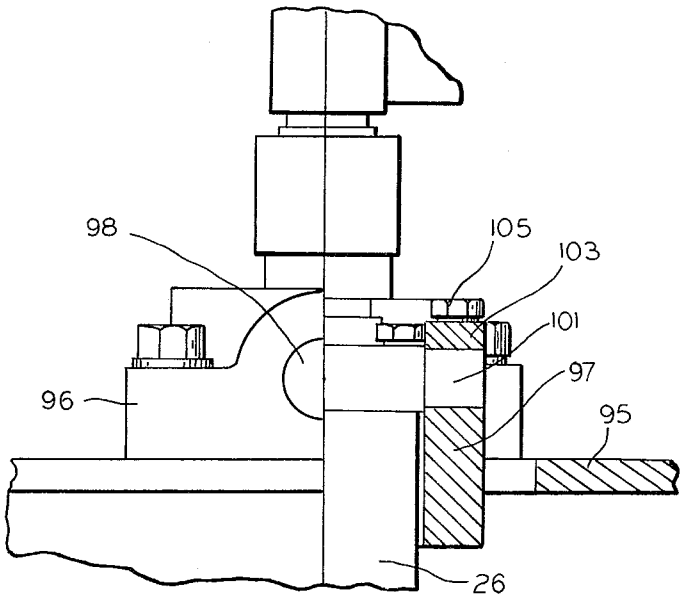
FIG. 7 is a view taken along line 7—7 of FIG. 3.
Figure 6:
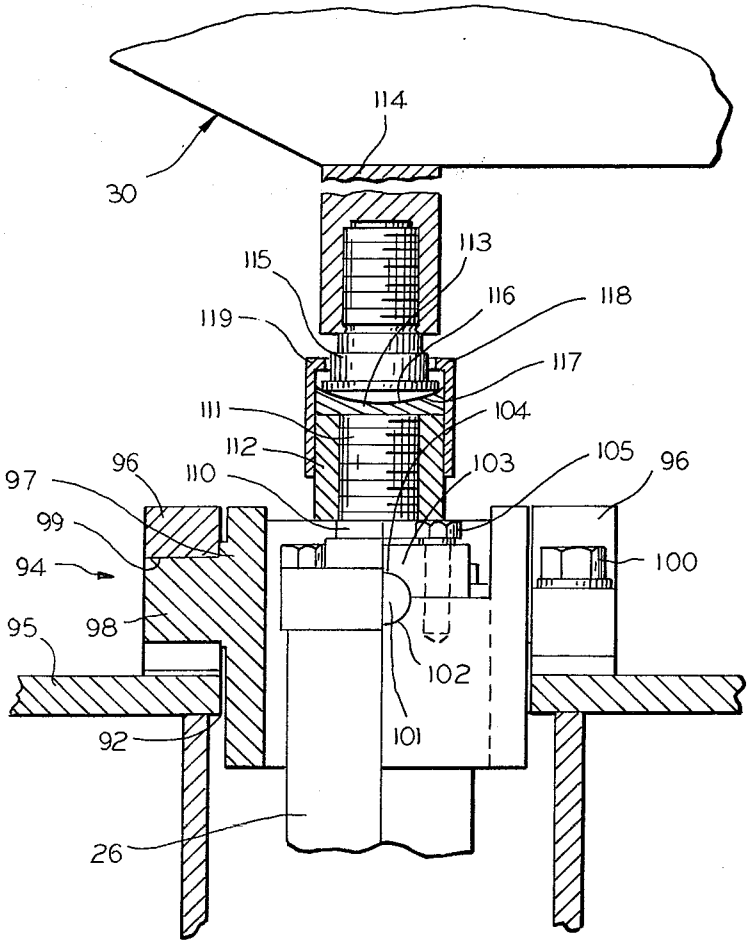
FIG. 6 is a view taken along line 6—6 of FIG. 3.

A plurality of vertically extending lift cylinders 26 for elevating the lift table 30 are mounted on a top plate 95 of support table 25 as shown particularly in FIGS. 1 and 3. While four cylinders 26 are illustrated, it will be appreciated that any suitable number may be employed. The cylinders 26 extend through and are mounted in apertures 92 formed in plate 95 and spaced apart in a generally rectangular array. As seen in FIGS. 6 and 7 cylinders 26 may be affixed at their upper ends in apertures 92 in any suitable manner such as by gimbal mountings 94 each of which includes a pair of spaced pillow blocks 96 affixed to the plate 95 and adjacent its respective opening 92 by means such as bolts 100. Each mounting 94 also includes a gimbal block 97 having laterally extending trunnion pins 98 which extend through an aperture 99 formed in each of the pillow blocks 96. Each gimbal block 97 also has a pair of semi-circular support surfaces formed in its upper end for receiving a pair of opposed trunnion pins 101 affixed to its associated cylinder 26 and extending transversely to the axis of gimbal trunnion pins 98. The trunnions 101 of each cylinder 26 is secured by means of a cap plate 103 affixed on gimbal housing 97 in any suitable manner such as bolts 105 and having a matching semi-circular recess 104 which fits over the trunnion pins 101.

A shaft assembly 106 couples the cylinder 26 to the lift table assembly 30 and includes a spherical coupling 107 to permit slight articulation. More specifically, each shaft assembly 106 includes a first shaft portion 110 extending from cylinder 36 and having a threaded end 111 for receiving a collar 112 which supports a shoe 113 forming a part of coupling 107 and having a concave upper surface. Shaft assembly 106 also includes a vertical shaft 114 whose upper end engages lift table assembly 30, and whose lower end is threaded for receiving the threaded shank of bearing member 115 which also forms a part of coupling 107. A head 116 is formed at its lower end having a convex bearing surface 117 which bears upon the concave surface of shoe 113. An annular retaining collar 118 is affixed to collar 112 in surrounding relation to head 116 and shoe 113 and has a radially inwardly extending flange 119 which retains the head 115 from vertically separating from shoe 112. The concave surface between head 115 and shoe 113 allows limited articulating motion of shaft 114. It will, therefore, be appreciated that the combination of the trunnion pins 98 and 101 supporting cylinder 26 and the limited articulation motion of shaft 114 substantially precludes side loading on the shafts 110 of the cylinders 26. Cylinders 26 may be supplied from any suitable hydraulic source, not shown.

Figure 5:
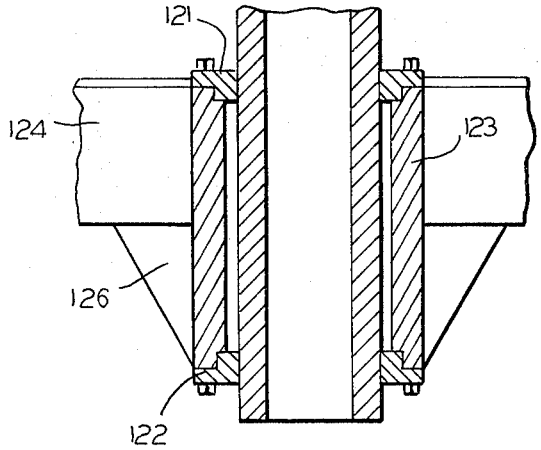
FIG. 5 is a view taken along line 5—5 of FIG. 3.

To absorb side loading from the tilt table load and to prevent rotation of the lift table 30, a square column 120 is shown in FIGS. 1, 3 and 5 to be affixed to the lift table 30 and extends vertically downwardly through the lift cylinder support table assembly 25. The column 120 extends through an opening in the center of top plate 95 and is slidably supported on beams 124, which form a part of the framework 65, by means of a pair of vertically spaced bearing supports 121 as seen in FIG. 5. Supports 121 and 122 are suitably mounted on the upper and lower ends of a hollow column 123 supported on beams 124 within the center of framework 65. The bearing supports 121 and 122 slidably engage the peripheral surface of the column 120 and act to absorb side loading forces emanating from the lift table assembly 30 supported on column 120. A plurality of gusset plates 126 are rigidly affixed to the bottom of beams 124 and the lower extension of column 132 to provide added rigidity in resisting side forces. The bearing supports 121 and 122 may be made in separate sections to provide for ease of replacement and repair as necessary.

Figure 9:
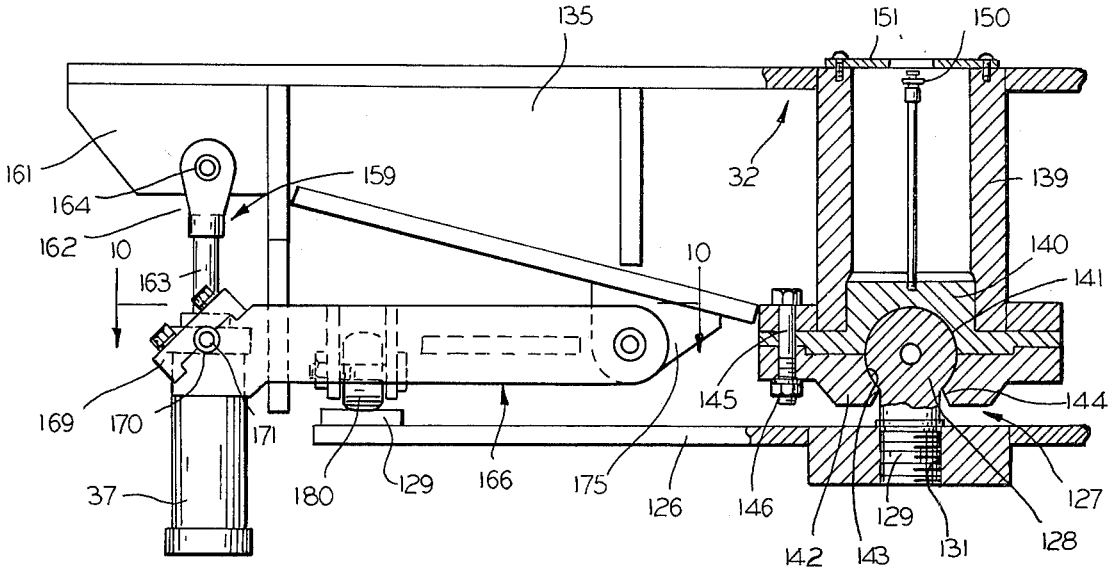
FIG. 9 is a view taken along line 9—9 of FIG. 8.

The lift table assembly 30 is shown in FIG. 1 to include a frame 125 which has a horizontally extending plate 126 defining its upper margin. The upper ends of a vertical column 120 and each of the coupling shafts 114 are suitably secured to frame 125 by any well known means. As is seen in FIGS. 1 and 9, the lift table assembly 30 serves as a support for and is coupled to the tilt table assembly 32 by means of a ball joint assembly 127 which includes a centrally located ball member 128 having a downwardly threaded shaft portion 129 which is received in a threaded aperture 130 formed in a block 131 secured to plate 126. A plurality of arcuate wear plates 129 are mounted on lift table top plate 126 and are spaced radially outward from the spherical member 127. The wear plates 129 support rollers attached to the tilt table assembly 32 as will be discussed hereinafter. Finally, the top plate 126 also supports cylinder assemblies 37 operative to rotate the tilt table assembly 32 which will be discussed more fully below.

The tilt table assembly 32 is shown in FIGS. 1 and 8 generally to include a generally horizontally extending frame comprising beams 135 and 136 which are suitably joined at their inner ends and radiate outwardly at right angles relative to each other to form an X-shaped framework. A hollow downwardly extending tubular housing 139 is disposed at the intersection of beams 135 and 136 as shown in FIG. 9 and carries the socket portion 137 of ball joint 127 at its lower end. More specifically a first socket member 140 is suitably affixed within housing 139 and has hemispherical shaped recess 141 which bears on the upper portion of the ball member 127 mounted on the lift table assembly 30. A retainer plate 142 having an upwardly facing spherical surface 143 which abuts the lower portion of spherical ball member 127 with the shaft 128 extending through a conical bore 144, which intersects surface 143. The plate 142 may be secured to socket 140 in any suitable manner such as bolts 145 and nut 146. It may thus be seen that the socket member 140 and retainer plate 142 embrace the ball member 127 whereby the tilt table assembly may pivot to the extent permitted by the clearance between opening 144 and ball joint 127. It will also be appreciated that the ball joint 127 also permits rotary motion of the tilt table assembly 32 about the vertical axis of ball 128. The ball joint 127 may be provided with a grease fitting 150 accessible through cover plate 151 whereby the surfaces of ball joint 127 may be lubricated.

Figure 10:
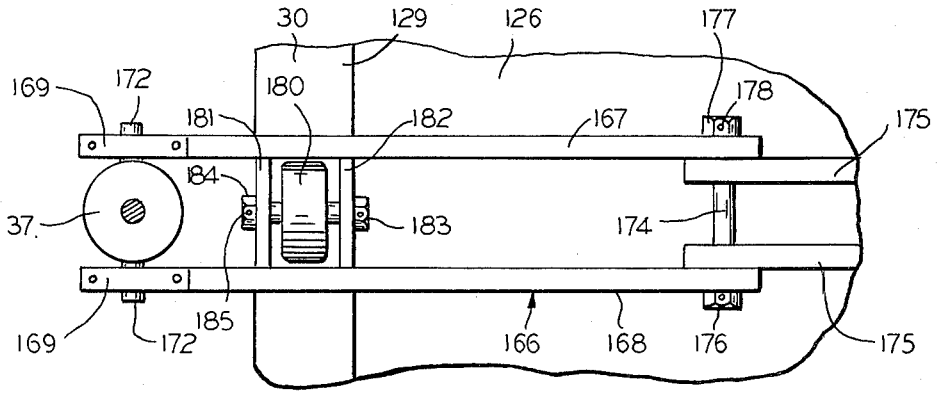
FIG. 10 is a view taken along line 10—10 of FIG. 9.

The means for tilting the tilt table assembly 32 relative to the lift table assembly 30 as seen in FIGS. 1 and 10 to include four single up acting hydraulic cylinders 37 one of which is pivotally connected to each of the outer ends of beams 135 and 136 of the tilt table 32 by means of a coupling assembly 159. Specifically, a flange 161 is affixed to the underside of each of the beams 135 and 136 and a clevis 162 affixed to the piston rod 163 of cylinder 37 and coupled to flange 161 by pin 162. The body of each cylinder 37 is similarly pivotally connected to the end of generally horizontally extending tilt link 166 which extends radially outward beneath each of the four beams 135 and 136. As may be seen in FIGS. 9 and 10, each of the tilt links 166 comprises a pair of spaced parallel members 167 and 168 which extend radially outward beyond the edge of the plate 126 of lift table assembly 30 and is terminate in a semi-circular bearing surface 170 each of which receives one of a pair of trunnion pins 171 extending transversely from cylinder 37. An end cap 172 has a surface 173 which mates with trunnion pins 171 and is suitably secured to each member 167 and 168 to secure said pins in position.

The radially inner ends of the link members 167 and 168 are pivotally connected by means of a pin 174 extending between a pair of brackets 175 affixed to the under surface of their respective beams 135 or 136. The pin 174 may be secured by nuts 177 and lock pins 178. A roller 180 is journaled between a pair of plates 182 and 183 mounted normally between members 167 and 168 intermediate the cylinder 37 and the pivot pin 174. The roller 180 is thus disposed with its axis of rotation paralleling the link elements 167 and 168 and is adapted to roll circumferentially around the lift table assembly 30 as it bears on the roller wear plates 129 affixed to the top 126 of lift table assembly 30.

As is shown in FIG. 9, the tilt link assembly 166 serves as a lever with the roller 180 acting as the fulcrum so that by moving the piston rod 161 up or down under the influence of hydraulic pressure, the link assembly 166 will be pivoted about the roller 180 to move its associated beam 135 or 136 upward or downward around the pivot pin 174 thereby tilting the tilt table assembly 32 about the ball joint 127. It will be appreciated that the tilt cylinders 37 on diametrically opposed beams must be coordinated so that an upward movement of a piston rod 163 on one side is compensated by a corresponding downward movement of the piston rod 163 on the opposite side of the tilt table assembly 32. Also, to accommodate the tilting motion, the peripheral surface of the rollers 180 is curved to provide a smoother tilting motion.

Figure 11:
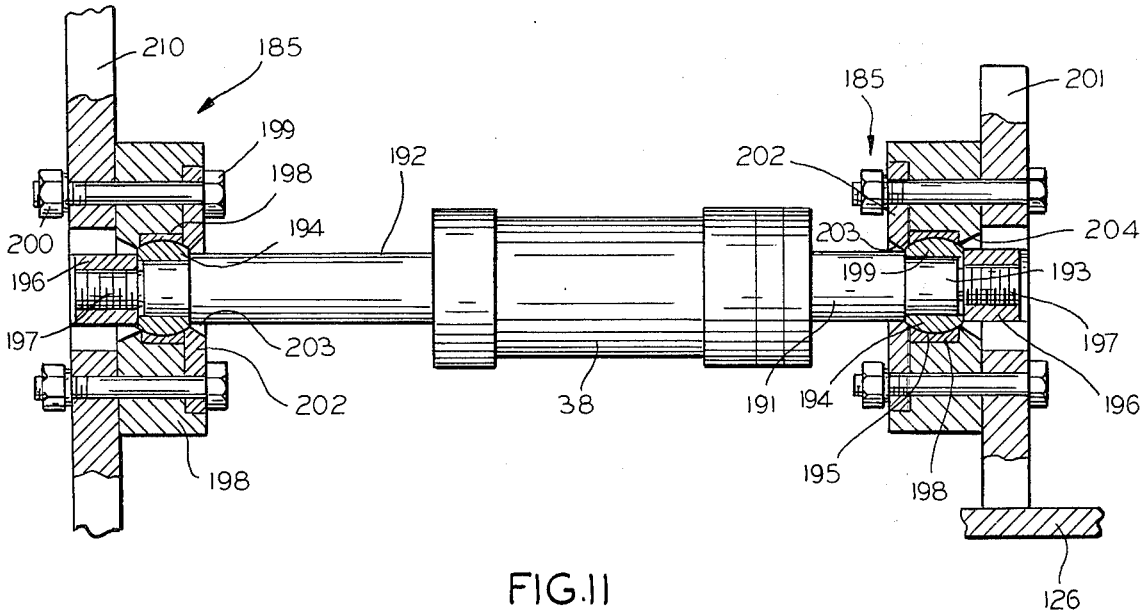
FIG. 11 is a view taken along line 11—11 of FIG. 8.

Limited rotation of the tilt table 32 may be accomplished by a pair of double acting hydraulic cylinders 38 which are shown in FIG. 8, to extend in a coacting relation between beams 35 and lift assembly 30. The axes of the cylinders 38 lie in a horizontal plane extending in a direction generally perpendicular to the beams 135 and are spaced from the spherical pivot member 127 to form a means of generating a moment couple which is exerted upon the tilt table assembly 32 about the vertical axis of ball joint 127. Each of the cylinders 38 are secured at its opposite ends by articulated couplings 185 to permit tilting of beams 135 and 136 relative to assembly 30. With reference to FIG. 11, each cylinder 38 is shown to have a fixed shaft 191 extending from one end and a movable piston shaft 192 extending from its other end. The stationary shaft 191 has a stepped down portion 193 for receiving a collar 194 provided with a spherical surface 195 and which is retained by a nut 196 threadably received on threaded end 197 of shaft 191. The surface 195 of collar 194 engages coupling 185 which includes an annular bushing 197 having an inner spherically concave surface 199 which engages surface 195. Bushing 197 is mounted in the bore of a block 198 which in turn is suitably secured to a bracket 201 which is affixed to the top plate 126 of the lift table assembly 30. An annular retainer plate 202 is secured, bolted on block 198 to retain the bushing 197 within the block 198. Both the block 198 and retainer plate 202 have conical bores 203 and 204 extending around the shaft 191 to allow limited articulating motion of the cylinder. As is seen in FIG. 11, the piston shaft 192 of cylinder 38 is identically mounted as shaft 191 and the parts are numbered the same, the only difference being that block 198 is connected to a flange 210 of beam 135 of the tilt table assembly 32. It will thus be appreciated that both ends of the shafts 191 and 192 of cylinders 38 are free to articulate within limited confines relative to their couplings 185. This articulating motion is necessary to accommodate the tilting motion of beams 135 and 136 due to the influence of cylinders 37 as tilting of the tilt table 32 would change the relative alignment of the ends of the cylinder shafts 191 and 192 by moving flanges 210 affixed thereto. It will be appreciated with reference to FIG. 8, that if the cylinders 37 receive fluid from any suitable source (not shown) to simultaneously extend their shafts 192, the beams 135 and 136 will be caused to rotate in a counter-clockwise direction around the ball joint 127. Conversely, if both of the piston shafts 192 are retracted within the cylinders 38, the beams 135 through 138 will be caused to rotate in a clockwise direction. Rotation of the beams 135 andd 136 is necessarily limited by the maximum stroke of the cylinders 38.

As seen in FIGS. 1 and 8, a vertically extending lug 215 is affixed to the top of the outermost ends of each of the tilt beams 135 and 136 for being coupled to coacting lugs 216 on vessel bottom 13. More specifically the vessel bottom assembly 13 has four pairs of vertically oriented lugs 216 affixed to steel shell 14 and spaced apart 90° around the vessel periphery. Lugs 216 are adapted to receive the lugs 215 of the tilt table therebetween and a generally rectangular aperture 217 extends through both lugs 215 and 216 for receiving a tapered key 218 to securely attach to the tilt table assembly 32 to the vessel bottom 13.

A work platform assembly 33 is provided on the adapter frame assembly 20 as seen in FIGS. 1, 2 and 8. Basically the platform assembly 33 includes a structural steel framework 220 which supports a horizontal floor of expanded metal grating 221 extending around the lift table assembly 30 and tilt table assembly 32. An aperture 222 is formed in grating 221 to permit lowering the lift and tilt table assemblies 30 and 32 down below the level of the grating 221.

In operation of the bottom removal apparatus the adapter frame assembly 20 containing the lift cylinder support table assembly 25, lift table assembly 30, tilt table assembly 32 and work platform 33 is lifted and positioned on a ladle car 21 and secured in place with ratchet jack assemblies 50. This initial positioning of the bottom removal apparatus on the ladle car 21 is normally done at a point remote from the vessel 10, after which the entire assembly is moved on the ladle car 21 along tracks 22 to a point below the converter vessel 10 and its bottom assembly 13. Workmen on the platform assembly 33 may then disconnect the gas piping connections 18 and 19 after which the lift table assembly 30 is raised by means of the lift cylinders 26 upward until the tilt table assembly engages the vessel bottom assembly 13. As the tilt table assembly 32 approaches contact with the vessel bottom assembly 13, the tilt cylinders 37 are actuated as necessary to align the top surface of the tilt table assembly 32 with the lower surface of the bottom assembly 13, and the rotation cylinders 38 would be actuated as necessary to rotate the tilt table assembly 32 to position the lugs 215 to be aligned with the space between the parallel lugs 216 affixed to the vessel bottom 13. After adequate alignment of the lugs 251 and 26, the lift cylinders 26 are actuated to raise the tilt table 32 into a position supporting the vessel bottom 13 and keys 218 are inserted in the lugs 215 and 216 to secure the bottom assembly 213 on the tilt table 32. At this point, the connections between the vessel bottom 13 and the vessel 10 itself are disengaged thus preparing the bottom 13 for withdrawal downwardly from the vessel 10. The bottom assembly is then ready for withdrawal from the vessel 10 and the lift cylinders 26 may be actuated to withdraw cylinder shafts 110 thus exerting a downward force on the lift table 30 which in turn is transmitted to the tilt table assembly 32 and through the keyed connections 218 between 215 and 216, to pull the vessel bottom assembly 13 free of the vessel 10. Once the bottom assembly is withdrawn and lowered clear of the vessel 10, the ladle car 21 is moved clear of the vessel 10 and the bottom assembly 13 may be transported to a remote location for removal and rebuilding and a new bottom assembly 13 positioned on the lift table assembly 32 and transported on ladle car 21 back beneath vessel 10 for insertion of the new bottom assembly 13 into the vessel 10. Again, when the new bottom assembly 13 is lifted upwardly to a point proximate to the vessel 10, the bottom may be accurately aligned with the opening in the vessel 10 by means of the tilt cylinders 37 rotating cylinders 38 and the shift cylinders located in the adapter framework 35 and 36, which horizontally move the cylinder support table which in turn results in a horizontal shifting on lift table assembly 30, tilt table assembly 32, and the attached bottom assembly 13. As previously noted, any side loads due to uneven weight distribution of the vessel bottom on the tilt table assembly 32, are absorbed by the square column 120 extending from the lift table assembly 30, thus preventing side loading on the shafts 110 of cylinders 26 thereby prolonging their useful life.

Figure 12:
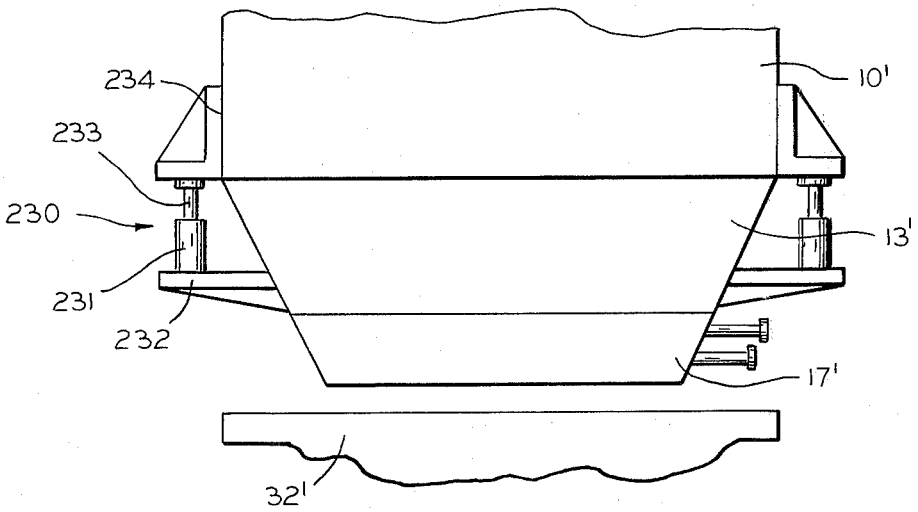
FIG. 12 is a partial side elevational view of an alternate embodiment of the invention.

An alternate embodiment of the invention is shown in FIG. 12 wherein parts corresponding to those of the previous embodiment are identically numbered with the addition of a prime. Basically, a converter vessel 10' is shown which has a bottom assembly 13' including a gas distribution housing 17'. The tilt table assembly 32' is depicted as being positioned slightly below the bottom assembly 13'. A plurality of hydraulic jacks 230 are provided which have their bodies 231 suitably affixed to radially outwardly extending support brackets 232 affixed to bottom assembly 13' by means such as welding Jacks 230 include vertically extensible shafts 233 which each have their ends aligned with the bottom of radially outwardly extending L-shaped brackets 234 attached to the sides of vessel 10' in any suitable manner such as welding. It may be seen that by extending the jack shafts 233 against brackets any further extension of shafts 233 will result in application of generally vertical opposed forces against the brackets 232 and 234 affixed to bottom 13' and vessel 10' respectively. These forces tend to break the vessel bottom 13' away from vessel 10' after which bottom 13' will be supportingly received by tilt table 32' of the lifting apparatus. The jacks 230 are supplied with pressurized hydraulic fluid in a manner well known in the art. In addition, any other suitable force producing means could be provided in place of the jacks 230, such as hydraulic cylinders of the like.

The utility of the alternate embodiment lies in the fact that breakaway forces between the bottom 13' and vessel 10' are limited solely by the combined capacities of the jacks 230 and brackets 232 and 234 unlike the previously described embodiment where the breakaway force exerted by lift cylinders 26 is limited to combine weight of the apparatus and its support car 21. If any greater force is exerted by the lift cylinders 26, the apparatus and car 21 would be lifted off tracks 22 thereby creating a dangerous situation.

It will be appreciated by those skilled in the art, that the invention thus described provides a means for quickly changing converter vessel bottom assemblies. Furthermore, the unit is capable of exerting a downward breakaway force on the vessel bottom which is often necessary to break the worn refractory bottom section loose from the adjoining brickwork in the furnace bottom.

While two embodiments of the invention have thus been described, the invention is not intended to be limited thereby but the scope of the invention is to be taken from an interpretation of the claims which follow.

We claim:

1. Apparatus for handling a vessel bottom which is attachable to and detachable from a metallurgical vessel, said apparatus comprising:

support means, lift means mounted on said support means and including power means, bottom receiving means for receiving and supporting said vessel bottom and being mounted on said lift means for rotational and tilting movement relative thereto, said lift means engaging said bottom receiving means and being operative to elevate said bottom receiving means vertically, first force producing means mounted on said lift means and engageable with said bottom receiving means for selectively tilting the latter relative to a horizontal plane, and second force producing means mounted on said lift means and engaging said bottom receiving means for selectively rotating the latter relative to said lift means and about a nominally vertical vertical axis.

2. The invention set forth in claim 1 including:

third selectively operable force producing means coupled to said support means and said lift means and being operative for moving said bottom receiving means and said lift means relative to said support means in a first generally horizontal direction and a second generally horizontal direction generally normal to said first generally horizontal direction.

3. The apparatus set forth in claim 2 wherein said support means including first and second support portions, said lift means being mounted on said first support portion, said third force producing means comprising a pair of power elements respectively extending in said first and second horizontal directions and each engaging said first and second support portions for moving said first support portion and said lift means horizontally relative to said second support portion.

4. The apparatus set forth in claim 3 wherein:

said power elements each comprise selectively operable cylinder means articulatingly connected to said first and second support portions and, bearing means disposed between said first and second support portions for slidingly supporting said first support portion on said second support portion.

5. The apparatus set forth in claim 4 including restraining means associated with said bearing means for preventing relative vertical movement between said first and second support portions.

6. The apparatus set forth in claim 5 wherein: said restraining means comprise a plurality of vertically extending post means affixed to one of said support portions and extending through apertures formed in the other of said support portions, said bearing means being disposed between said post means and the other of said support portions.

7. The apparatus set forth in claim 6 wherein said bottom receiving means includes attachment means for releasably attaching said bottom receiving means to said vessel bottom, said lift means including bidirectionally operable and vertically extensible force producing means for vertically elevating said bottom receiving means and for exerting a vertically downward force on said vessel bottom to forcibly remove the same from said vessel.

8. The apparatus set forth in claim 1 wherein said first force producing means includes a plurality of radially extending circumferentially spaced lever means, the radially inner end of each lever means being pivotally connected to said bottom receiving means, roller means rotatably mounted intermediate the ends of each of said lever means, said roller means engaging said lift means, said first force producing means also comprising a bidirectionally operable tilt cylinder pivotally supported between the radially outer end of each lever means and said bottom receiving means, said tilt cylinders being selectively operable whereby extension or retraction of said tilt cylinders will pivot said levers about said rollers and cause said bottom receiving means to tilt.

9. The apparatus set forth in claim 8 and including a pivot support disposed between said bottom receiving means and said lift means, said pivot means comprising ball means mounted adjacent the center of one of said bottom receiving means and lift means and socket means mounted on the other of said bottom receiving and lift means, said ball and socket means supporting said bottom receiving means for tilting and rotational movement on said lift means.

10. The apparatus set forth in claim 9 wherein said lift means includes vertically extensible means and means for moving said extensible means vertically to selectively elevate and lower said bottom receiving means, said means includes frame means and translatable means engageable with said bottom receiving means and said frame means, said vertically extensible means being mounted on said frame means and engageable with said translatable means for elevating said bottom receiving means.

11. The apparatus set forth in claim 10 wherein said bottom receiving means includes attachment means for releasably attaching said bottom receiving means to said vessel bottom, said lift means including bidirectionally operable, vertically extensible force producing means for vertically elevating said bottom means and for exerting a vertically downward force on said vessel bottom to forcibly remove the same from said vessel.

12. The apparatus set forth in claim 1 and including pivot support means disposed between said lift means and bottom receiving means, said first force producing means comprises a plurality of selectively operable, bidirectional power elements disposed in spaced apart relation about said pivot support means and engaging said bottom receiving means for applying selective tilting forces thereto at spaced apart points thereof for selective universal tilting.

13. The apparatus set forth in claim 12 wherein said power elements comprise a plurality of double acting fluid operated cylinder means mounted on said support means and having extensible portions pivotally connected to said bottom receiving means for bidirectionally tilting said pivot support means.

14. The apparatus set forth in claim 13 wherein said first force producing means includes a plurality of radially extending circumferentially spaced lever means, the radially inner end of each lever being pivotally connected to said bottom receiving means, roller means pivotally mounted intermediate the ends of each of said lever means, said roller means engaging said support means, one of said power elements being pivotally supported between the radially outer end of each of said lever means and said lift means, whereby extension or retraction of said power elements will pivot said levers about said rollers and cause said bottom receiving means to tilt.

15. The apparatus set forth in claim 1 and including bearing means mounted on said support means, said bottom receiving means being mounted on said bearing means for rotational movement about a generally vertical axis, said second force exerting means engaging said support means and said bottom receiving means for rotating said bottom receiving means about said vertical axis and relative to said support means.

16. The apparatus set forth in claim 15 wherein said second force producing means comprises bidirectionally operable extensible means extending in a generally horizontal direction.

17. The apparatus set forth in claim 16 wherein said bearing means comprises ball means mounted adjacent the center of one of said bottom receiving means and lift means and socket means mounted on the other one thereof and roller means disposed between peripheral portions thereof.

18. In combination with a vessel bottom which is attachable to and detachable from a metallurgical vessel, an apparatus for handling said vessel bottom comprising:

support means, lift means mounted on said support means and including extensible power means, bottom receiving means for receiving and supporting said vessel bottom and being affixed to said lift means, said lift means being operative to elevate said bottom receiving means vertically, attachment means for releasably attaching said bottom receiving means to said vessel bottoms and a plurality of hydraulic means disposed between said vessel bottom and said vessel for breaking said bottom from said vessel.

19. In combination with a vessel bottom which is attachable to and detachable from a metallurgical vessel, an apparatus for handling said vessel bottom comprising:

support means, lift means mounted on said support means and including extensible power means, bottom receiving means for receiving and supporting said vessel bottom and being affixed to said lift means, said lift means mounted on said support means and includes bidirectionally operable force exerting means operative to elevate said bottom receiving means vertically, attachment means for releasably attaching said bottom receiving means to said vessel bottom, said force exerting means also being operable for exerting a vertically downward force on said vessel bottom relative to said vessel to remove said bottom from said vessel.

20. The apparatus set forth in claim 19 wherein said force producing means comprises double acting hydraulic cylinder means, said support means includes car means, whereby operation of said hydraulic cylinder means to lower said bottom receiving means subjects said bottom to the weight of said apparatus when said bottom receiving means is affixed to said bottom.

21. The apparatus set forth in claim 20 wherein said bottom receiving means is mounted on said lift means for rotational and tilting movement relative thereto, first force producing means mounted on said lift means and engageable with said bottom receiving means for selectively tilting the latter relative to a horizontal plane, second force producing means mounted on said lift means and engaging said bottom receiving means for selectively rotating the latter relative to said lift means and about a nominally vertical axis, and third selectively operable force producing means coupled to said support means and said lift means and being operative for moving said bottom receiving means and said lift means relative to said support means in a first generally horizontal direction and a second generally horizontal direction generally normal to said first generally horizontal direction.

22. The apparatus set forth in claim 21 wherein said support means including first and second support portions, said lift means being mounted on said first support portion, said third force producing means comprising a pair of power elements extending in said first and second horizontal directions and each engaging said first and second support portions for moving said first support portion and said lift means horizontally relative to said second support portion, said power elements each comprise selectively operable cylinder means articulatingly connected to said first and second support portions and, bearing means disposed between said first and second support portions for slidingly supporting said first support portion on said second support portion.

23. The apparatus set forth in claim 22 wherein said first force producing means includes a plurality of radially extending circumferentially spaced lever means, the radially inner end of each lever means being pivotally connected to said bottom receiving means, roller means rotatably mounted intermediate the ends of each of said lever means, said roller means engaging said lift means, said first force producing means also comprising a bidirectionally operable tilt cylinder pivotally supported between the radially outer end of each lever means and said bottom receiving means, said tilt cylinders being selectively operable whereby extension or retraction of said tilt cylinders will pivot said levers about said rollers and cause said bottom receiving means to tilt.

* * * * *

UNITED STATES PATENT OFFICE

CERTIFICATE OF CORRECTION

Patent No. 3,944,083 Dated March 16, 1976

Inventor(s) Howard M. Fisher et al

It is certified that error appears in the above-identified patent and that said Letters Patent are hereby corrected as shown below:

Claim 1, Column 10, Line 20, cancel "vertical" (second occurrence).

Signed and Sealed this

*first* Day of *June 1976*

[SEAL]

*Attest:*

RUTH C. MASON
*Attesting Officer*

C. MARSHALL DANN
*Commissioner of Patents and Trademarks*